United States Patent [19]

Borden

[11] Patent Number: 4,554,731

[45] Date of Patent: Nov. 26, 1985

[54] METHOD AND APPARATUS FOR MAKING SUPERCONDUCTIVE MAGNET COILS

[75] Inventor: Albert R. Borden, El Cerrito, Calif.

[73] Assignee: The United States of America as represented by the United States Department of Energy, Washington, D.C.

[21] Appl. No.: 549,379

[22] Filed: Nov. 7, 1983

[51] Int. Cl.[4] ..... H01F 7/06

[52] U.S. Cl. ..... 29/605; 29/599; 29/738; 29/760; 336/197

[58] Field of Search ..... 29/605, 599, 738, 745, 29/760; 335/213, 216; 336/197; 242/72.1

[56] References Cited

U.S. PATENT DOCUMENTS

| | | | |
|---|---|---|---|
| 1,281,861 | 10/1918 | Sibley | 242/72.1 |
| 2,013,764 | 9/1955 | Putnam | 29/605 |
| 2,614,588 | 10/1952 | Laycock | 140/92.2 |
| 2,733,873 | 2/1956 | Petersen | 242/72.1 |
| 3,086,562 | 4/1963 | Price | 140/92.2 |
| 3,270,304 | 8/1966 | Hoppie | 335/216 |
| 3,672,026 | 6/1972 | Cutler et al. | 29/605 |
| 3,866,847 | 2/1975 | Droll | 242/72.1 |
| 4,271,585 | 6/1981 | Satti | 335/216 |

FOREIGN PATENT DOCUMENTS

| | | | |
|---|---|---|---|
| 97715 | 8/1979 | Japan | 29/605 |

OTHER PUBLICATIONS

"Magnet Failures Imperil New Accelerator," Science, vol. 210, Nov. 21, 1980, pp. 875–878.

"Balky Proton Smasher," Science, N.Y. Times, vol. 130, 11/28/80.

"Alternative Isabelle Magnet Model Tested," Currents, Newsletter of Lawrence Berkeley Laboratory, Univ. of Calif., vol. 8, No. 19, May 22, 1981.

Taylor, C. et al., "Design of Epoxy-Free Superconducting Dipole Magnets & Performance in both Helium I & Pressurized Helium II," LBL-12455, IEEE Transactions on Magnetics, vol. MAG-17, No. 5, Sep. 1981.

Taylor, C. et al., "Alternative Dipole Magnets for Isabelle," presented at 9th International Cryogenic Engineering Conference, Kobe, Japan, May 11-14, 1982.

Annual Report, Accelerator & Fusion Research Division, Lawrence Berkeley Laboratory, University of California, Apr. 1982, LBL-14230, pp. 15–18.

Taylor, C. et al., "High Field Superconducting Accelerator Magnets," LBL 14400, May 1982, presented at Ninth International Cryogenic Engineering Conference, Kobe, Japan, May 11-14, 1982.

*Primary Examiner*—Howard N. Goldberg
*Assistant Examiner*—P. W. Echols
*Attorney, Agent, or Firm*—L. E. Carnahan; Roger S. Gaither; Judson R. Hightower

[57] ABSTRACT

A curved, shell-type magnet coil, adapted to be used in a superconducting magnet, is wound by providing a mandrel having a tubular cylindrical mid-portion terminating at both ends in tapered end portions formed with longitudinal slots having flexible fingers therebetween. An elongated electrical conductor is wound around an elongated oval-shaped pole island engaged with the outside of the cylindrical mid-portion, to form a multiplicity of oval-shaped turns engaged with a 180-degree segment of the mandrel. The coil turns have longitudinal portions with curved portions therebetween, engaging the tapered end portions of the mandrel. Upon completion of the winding, tapered expansion members are fully inserted into the tapered end portions, to displace the flexible fingers outwardly into a cylindrical form and to displace the curved portions of the turns into a shape conforming to such cylindrical form while also exerting increased tension upon the turns to minimize draping of the turns and to enhance the mechanical integrity of the coil. A half cylinder clamp may then be employed to clamp the coil, whereupon the coil may be solified by the use of an epoxy adhesive.

13 Claims, 3 Drawing Figures

METHOD AND APPARATUS FOR MAKING SUPERCONDUCTIVE MAGNET COILS

The U.S. Government has rights in this invention pursuant to Contract No. DE-AC03-76SF00098 between the U.S. Department of Energy and the University of California.

FIELD OF THE INVENTION

This invention relates to a method and apparatus for making curved generally pancake-shaped coils adapted to be mounted around a 180-degree segment of a cylindrical support, such coils being particularly useful for use as superconducting magnet coils. However, the invention is applicable to the manufacture of coils generally, whether superconductive or normally conductive. Such superconductive magnet coils may be employed very advantageously in pairs of coils, mounted around opposite 180-degree segments of a cylindrical support to provide a dipole magnet which produces an extremely intense magnetic field extending across the inside or bore of the support. Such dipole magnets are useful as beam bending magnets in accelerators for accelerating charged particles to extremely high energy levels.

BACKGROUND OF THE INVENTION

Research and development are underway to produce the next generation of accelerators for accelerating charged particles to extremely high energies for high energy physics. In such accelerators, a beam of charged particles is generally caused to travel around a circular path. In very large accelerators, the circular path may be many kilometers (km) in circumference. Such accelerators require high-field, small-bore, dipole beam bending magnets capable of producing magnetic fields on the order of ten T (Tesla). In such accelerators, the magnets must produce extremely high intensity magnetic fields to minimize the circumference of the circular beam tube, so as to minimize the cost of the accelerator. A very large accelerator is extremely costly, because of the high costs of land acquisition, tunnel construction, shielding construction, and the provision of the cryogenic distribution system, vacuum system and the like. Even with magnets developing fields of ten T, an accelerator capable of developing an energy level of 30 TeV could have a circumference as great as 80 kilometers.

The cost of the magnets for such an accelerator can be reduced by reducing the size of the magnets. The particle beam for such an accelerator can in principle be as small as 20 millimeters (mm) in diameter, or even smaller. The beam can be contained within an accelerator bore having a diameter of about 40 mm, for which a winding diameter of about 60 mm is feasible. However, it is difficult to make coils having such a small winding diameter. Moreover, such coils require higher current densities in the superconductor than is used in present accelerator magnets.

The present invention relates to the production of such coils of the layer or shell type which are curved and generally pancake-shaped and are adapted to be mounted around a 180-degree segment of a cylindrical support. Such curved layer-type coils are used in pairs on opposite sides of the cylindrical support. The complete coil assembly may have several superimposed layers on both sides of the cylindrical support. In such layer or shell-type windings, the electrical conductor or cable is generally rectangular or flat in cross section and is wound with the edge of the cable engaging the cylindrical supporting surface. Such coils are difficult to wind because of the curvature of the coils. To accommodate the curvature, the conductors must be wedge-shaped in cross section, or may employ separate wedges, interspersed between some of the turns, to make the winding solid and immovable, so that the winding will withstand the very high magnetic forces which are developed in the coils, due to the very high currents which are possible under superconductive operating conditions. Any movement of the coil conductors is to be avoided during operation, because such movement generates heat which can cause the loss of superconductivity.

In such curved shell-type coils, the turns are generally oval-shaped, with longitudinal portions and curved portions extending therebetween. Even though the turns are wound under tension, the longitudinal portions tend to drape along catenary curves. This draping effect makes it difficult to confine each coil to a 180-degree segment of a cylindrical supporting surface. The draping of the turns tends to make the coil less solid and compact than would be desirable.

In the past, attempts have been made to deal with the problem of draping and looseness of the turns by clamping the finished coils in various ways, such as by the use of rings and helical wrappings. Moreover, adhesive materials have been used in significant quantities to fill in the spaces between the turns and to solidify coils. Such adhesive materials have included epoxy resins which are polymerized after the coils have been completed.

The principal object of the present invention is to provide an improved method and apparatus for making such coils, so as to deal more effectively with the problems of draping and looseness of the turns, whereby coils of enhanced quality may be produced. The improved coils are more solid and compact and less subject to movement during operation, so that the loss of superconductivity is less likely to occur. When superconductivity is lost, it is necessary to again cool the coils until they become superconductive. The accelerator goes out of service when superconductivity is lost, and can only be returned to service when superconductivity has been restored in all magnets.

SUMMARY OF THE INVENTION

To accomplish this and other objects, the present invention preferably provides a method of making a curved generally pancake-shaped coil adapted to be mounted around a 180-degree segment of a cylindrical support, such method comprising the steps of providing a tubular mandrel having a tubular cylindrical substantially rigid mid-portion terminating at both ends in tapered tubular end portions formed with a multiplicity of longitudinal slots providing flexible fingers between such slots, providing an elongated oval-shaped pole island in engagement with the outside of the cylindrical mid-portion and parallel with the axis thereof, winding an elongated electrical conductor around such pole island to form a multiplicity of generally oval-shaped turns in engagement with a 180-degree segment of the outside of the mandrel, such turns having longitudinal portions with curved portions extending therebetween, the curved portions of at least some of the turns engaging such tapered end portions of the mandrel, providing tapered expansion members of circular cross section for expanding the tapered end portions, and inserting the expansion members into the tapered end portions of the mandrel and thereby displacing the flexible fingers outwardly into a generally cylindrical form so as to displace the curved portions of the turns into a shape conforming to such cylindrical form while also exerting increased tension upon the turns of the coil to minimize draping of the longitudinal portions of the turns and to enhance the mechanical integrity of the coil.

A clamping member may be provided in the form of a half cylinder, which is employed to clamp the coil while inserting the expansion members. The clamping half cylinder assists in precisely shaping the coil to fit around the 180-degree segment of the supporting surface.

An epoxy material, or some other adhesive material, may be provided for securing the turns of the coil together and maintaining the shape of the coil upon the removal of the coil from the mandrel. The adhesive material is caused to set after the insertion of the expansion members into the end portions of the mandrel and after clamping the coil with the half cylinder clamping member. The setting of the epoxy material is accomplished by causing the epoxy material to polymerize.

The electrical conductor is preferably provided in a form utilizing an electrically conductive material which exhibits the property of superconductivity when cooled below a predetermined temperature near absolute zero. For example, the electrical conductor may be made of NbTi. Other known or suitable superconductive materials may be employed. However, the present invention is also applicable to coils having only normal conductivity.

The present invention also preferably provides apparatus for use in winding a curved generally pancake-shaped shell-type coil adapted to be mounted around a 180-degree segment of a cylindrical support, such apparatus comprising a tubular mandrel having a tubular cylindrical substantially rigid mid-portion terminating at both ends in tapered tubular end portions formed with a multiplicity of longitudinal slots providing flexible fingers between such slots, an elongated oval-shaped pole island in engagement with the outside of such cylindrical mid-portion of the mandrel and parallel with the axis thereof, such mandrel and such pole island being adapted to support a multiplicity of generally oval-shaped turns of an elongated electrical conductor wound around such pole island and in engagement with a 180-degree segment of the outside of said mandrel, the turns having longitudinal portions with curved portions extending therebetween, the curved portions of at least some of the turns engaging the tapered end portions of the mandrel, and tapered expansion members of circular cross section for insertion into the tapered end portions of the mandrel to displace the flexible fingers outwardly into a generally cylindrical form so as to displace the curved portions of the turns into a shape conforming to such cylindrical form while also exerting increased tension upon the turns of the coil to minimize draping of the longitudinal portions of the turns and to enhance the mechanical integrity of the coil.

Preferably, the tapered expansion members are initially partially inserted into the tapered end portions of the mandrel. The tapered expansion members are movable into fully inserted positions within the tapered end portions upon completion of the winding of the coil.

The apparatus may include a clamping member in the form of a half cylinder, movable into clamping engagement with the completed coil to assist in shaping the coil to fit around a 180-degree segment of a cylindrical support.

BRIEF DESCRIPTION OF THE DRAWINGS

Further objects, advantages and features of the present invention will appear from the following description, taken with the accompanying drawings, in which.

DETAILED DESCRIPTION OF ILLUSTRATIVE EMBODIMENTS

Figure 1:
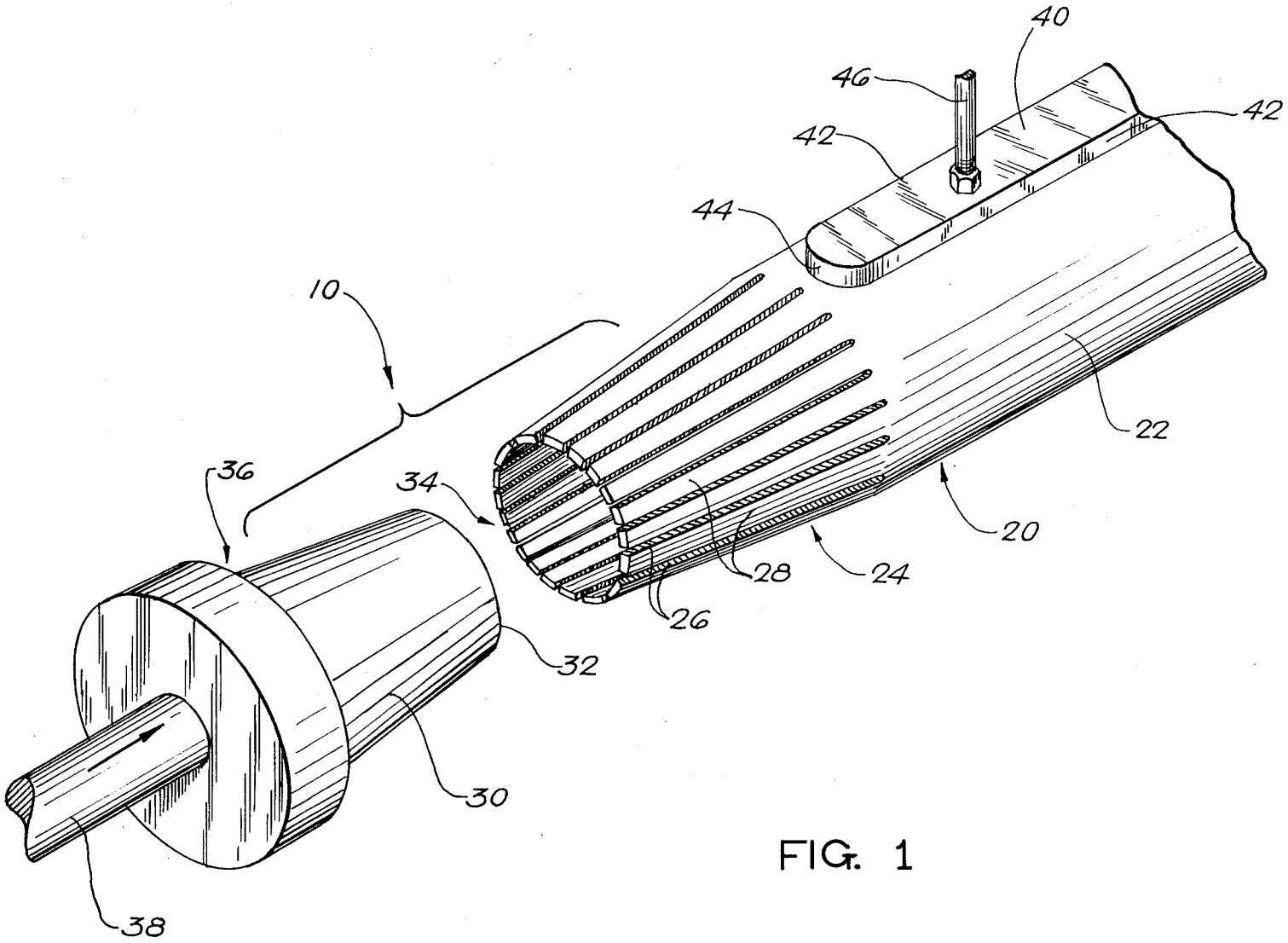
FIG. 1 is a fragmentary perspective view showing coil winding apparatus to be described as an illustrative embodiment of the present invention.
Figures 2, 3:
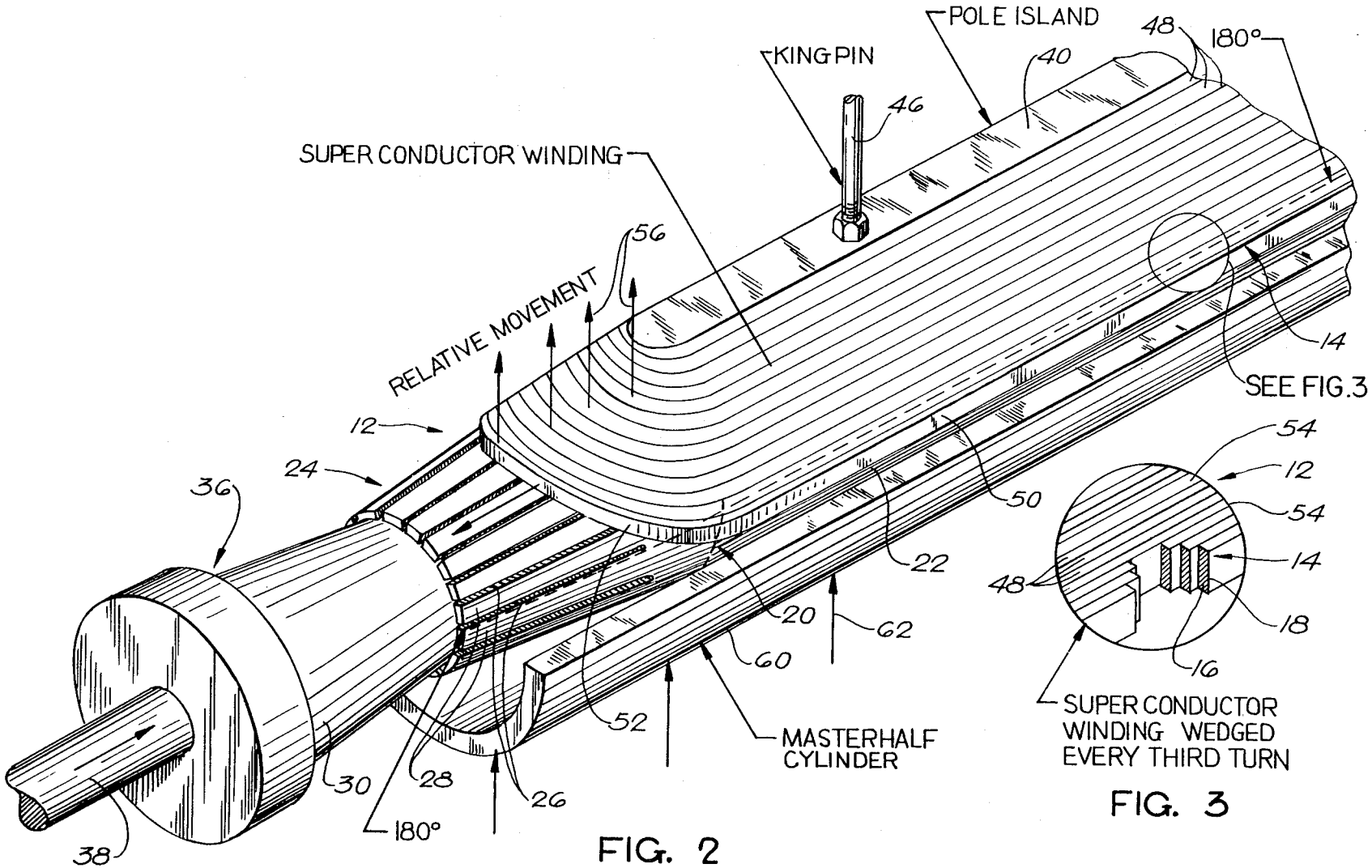
FIG. 2 is a perspective view showing a coil winding method constituting an illustrative embodiment of the present invention, utilizing the illustrative apparatus of FIG. 1, the apparatus being shown with a partially completed coil wound thereon.
FIG. 3 is an enlarged fragmentary perspective view, partly in section, corresponding to an inset portion of FIG. 2, showing details as to the manner in which the coil is wound.

FIG. 1 illustrates coil winding apparatus 10 to be described as an illustrative embodiment of the present invention, for use in winding a curved shell-type, generally pancake-shaped coil 12 of the general construction illustrated in FIGS. 2 and 3. As previously indicated, coils of this type are adapted to be mounted in pairs around opposite 180-degree segments of a cylindrical support, to form a dipole electromagnet. Dipole magnet coils of this type are highly advantageous for use as beam bending magnets in accelerators adapted to accelerate charged particles to extremely high energy levels. For such service, such coils are generally made superconductive, so that the coils have essentially zero resistance and do not dissipate energy resistively.

Thus, the coil 12 of FIGS. 2 and 3 employs an elongated electrical conductor or wire 14 which comprises an electrically conductive material 16 which exhibits the property of superconductivity, when cooled below a predetermined temperature near absolute zero. For example, the superconductive material 16 may be NbTi. However, any other known or suitable superconductive material may be employed. The electrical conductor or wire 14 is generally insulated by a covering or coating 18 of a suitable electrically insulating material, such as a resinous plastic material. As shown, the electrical conductor or wire 14 is in the form of a flat strip which is rectangular in cross section. However, other cross sectional shapes may be employed.

The coil winding apparatus 10 of FIG. 1 includes a coil winding mandrel 20 which is tubular and generally cylindrical and is employed as a support for winding the coil 12. The mandrel 20 may be made of metal, such as stainless steel or aluminum, or any other suitable material.

The mandrel 20 of FIG. 1 has a cylindrical midportion 22 which is substantially rigid to serve as a firm support for winding the coil 12. The cylindrical midportion 22 terminates at both ends in tapered tubular end portions 24. Only the left-hand end portion 24 is shown in FIG. 1. The right-hand end portion may be identical. Each end portion 24 tapers from the diameter of the cylindrical mid-portion to a somewhat smaller diameter. Thus, the outer surface of the tapered end portion 24 is generally frusto-conical in shape.

The tapered portion 24 of the mandrel 20 is expandable into a cylindrical form. For this purpose, the tapered end portion 24 is formed with a multiplicity of longitudinal slots 26, providing flexible fingers 28 therebetween. The fingers 28 are capable of being flexed outwardly, so that the tapered end portion 24 is expanded into a cylindrical form.

Such expansion may be accomplished by inserting a tapered expansion member 30 into the tapered end portion 24 of the mandrel 20. The tapered expansion member 30 is circular in cross section and has a smaller end 32 with a diameter sufficiently small to be inserted into the smaller end 34 of the tapered end portion 24. The tapered expansion member 30 has a larger end portion 36 having a diameter which is sufficiently large to expand the flexible fingers 28 into a cylindrical form when the expansion member 30 is fully inserted into the tapered end portion 24 of the mandrel 20.

As previously indicated, only the left-hand tapered end portion 24 and the left-hand tapered expansion member 30 are illustrated in FIG. 1. The right-hand end of the mandrel 20 is provided with an identical tapered end portion 24 and an identical tapered expansion member 30. Means are provided for fully inserting each tapered expansion member 30 into the corresponding tapered end portion 24 of the mandrel 20, such means being represented in FIG. 1 by a shaft 38 which supports the expansion member 30 and is movable mechanically, as by power means, for fully inserting the tapered expansion member 30 into the tapered end portion 24.

The coil winding apparatus 10 of FIG. 1 also includes a pole island or form 40 which engages the outside of the cylindrical mid-portion 22 of the mandrel 20. As shown, the pole island 40 is elongated and generally oval-shaped and is oriented parallel with the axis of the mandrel 20. As shown, the pole island 40 has a pair of longitudinal side surfaces 42, with rounded end surfaces 44 extending therebetween. Only the left-hand end surface 44 is shown in FIG. 1. The right-hand end surface may be identical. The rounded end surfaces 44 are substantially in the form of half cylinders. The pole island 40 is provided with a supporting pin 46.

FIGS. 2 and 3 illustrate the method of winding the coil 12. To start the coil winding method, the first turn of the coil 12 is wound by winding the electrical conductor or wire 14 around the pole island 40. Tension is maintained in the wire 14 during the winding operation. The second and subsequent turns of the coil 12 are wound around the preceding turns. All of the turns 48 of the coil 12 are wound with the lower edge of the wire 14 in firm engagement with the mandrel 20, so that a curved, shell-type generally pancake-shaped coil is produced.

Each turn 48 of the coil 12 is generally oval-shaped, as established by the oval shape of the pole island 40. Each turn 48 of the coil 12 has a pair of longitudinal side portions 50 with a pair of curved end portions 52 extending therebetween. Only the left-hand curved end portions 52 of the turns 48 are shown in FIG. 2. The right-hand end portions are identical. The two longitudinal sides 50 of each turn 48 are identical. To facilitate the winding operation, the mandrel 20 may be mounted on a winding turntable, in a manner which is well-known to those skilled in the art.

The successive turns 48 of the coil 12 are wound as tightly and compactly as possible. To accommodate the cylindrically curved shape of the coil 12, the turns are wedged, at least at intervals. As shown in FIG. 3, every third turn is wedged, by wrapping a wedging strip 54 around every third turn. The wedging strip 54 is wedge-shaped in cross section and may be made of a suitable flexible material, such as a resinous plastic material. By wedging turns 48, they are kept tightly compressed together, to minimize the formation of spaces between the turns. The need for separate wedging strips can be obviated by using wire having a wedge-shaped cross section.

During the winding of the coil 12, each tapered expansion member 30 is partially inserted into the corresponding tapered end portion 24 of the mandrel 20, to stabilize the tapered end portion 24. The curved end portions 52 of at least some of the turns 48 are engaged with the tapered end portions 24 of the mandrel 20.

When the winding of the coil 12 has been completed, such that the turns 48 are wound beyond the 180° point on mandrel 20 as shown in FIG. 2, each of the tapered expansion members 30 is fully inserted into the corresponding tapered end portion 24 of the mandrel 20. In this way, the flexible fingers 28 are flexed or displaced outwardly into a cylindrical form. This expansion of the tapered end portions 24 displaces the curved end portions 52 of the coil turns 48 outwardly, in the direction of relative movement as indicated by arrows 56 in FIG. 2. Such outward displacement of the curved end portions 52 has the highly advantageous effect of increasing the tension in the coil turns 48, and minimizing the draping of the longitudinal portions 50 of the turns 48. Even though the coil 12 is wound under tension, the longitudinal portions 50 of the turns 48 tend to drape slightly along catenary curves. The outward displacement of the curved end portions 52 of the coil turns 48 greatly reduces the draping of the longitudinal portions 50, so that they are confined more precisely to a 180-degree segment of the mandrel. Moreover, the longitudinal portions 50 of the adjacent turns 48 are drawn more closely and tightly together to form a more compact coil.

Simultaneously, with the insertion of the expansion members 30, to expand the tapered end portions 24 of the mandrel 20 to a cylindrical form, the coil 12 may be clamped by using a clamping member 60 in the form of an accurate half cylinder, as shown in FIG. 2. The clamping action of the half cylinder clamping member 60 assists in forming the coil 12 into the desired final shape by pushing the lower or outer turns 48 upwardly on mandrel 20 to the 180° point as shown in FIG. 2, so as to fit accurately around a 180-degree segment of the mandrel 20. The clamping member 60 is moved upwardly into clamping engagement with the mandrel 20 and the coil 12, in a direction of movement indicated by the arrow 62 in FIG. 2.

One or more other temporary clamping members may be clamped against the turns 48 of the coil 12 to assist in compressing the turns 48 solidly against the mandrel 20, in accordance with clamping procedures which are known to those skilled in the art. Such temporary clamping members may include one or more curved horn-shaped clamps, or another half cylindrical clamp, for example.

After the coil 12 has been formed into its final shape, by fully inserting the expansion members 30 into the tapered end portions 24 of the mandrel 20, and by utilizing the half cylinder clamp 60, and possibly other temporary clamps, an adhesive material is preferably employed to secure the turns 48 of the coil 12 together, so as to solidify and maintain the final shape of the coil 12, so that it can be removed from the mandrel 20 while maintaining the final shape of the coil 12. In this way, the coil 12 can easily be transferred from the mandrel 20 to its final cylindrical support, to fit precisely around a 180-degree segment of such support. Another identical coil is mounted around the opposite 180-degree segment of the final cylindrical support. The adhesive material is caused to set after the coil 12 has been expanded and clamped into its final shape.

The adhesive material may be applied to the wire 14 as it is wound to form the coil 12. Alternatively, the coil 12 may be impregnated with the adhesive material after it has been wound. The adhesive material is preferably an epoxy material which is caused to set by polymerizing the epoxy material. Because of the extremely tight and compact winding of the coil 12, only a small amount of the epoxy adhesive material is required to secure the turns 48 together and to solidify and maintain the final shape of the coil 12.

The winding method and apparatus of the present invention produces a curved shell-type coil which is wound very tightly and compactly and is accurately shaped to fit precisely around a 180-degree segment of the final cylindrical support. The accurate shaping of the coil results in the production of the desired magnetic field with a high degree of accuracy, both as to field strength and distribution.

During superconductive operation, the coils are cooled below the desired predetermined temperature near absolute zero, usually by the use of liquid helium as a coolant. Because of the extremely tight and compact construction of the coils, they perform very well as to withstanding the stresses due to such extreme cooling, without damage to the epoxy adhesive. Moreover, the coils perform very well as to withstanding the very large magnetic forces developed during superconductive magnet operation, due to the highly intense magnetic fields produced by the large currents in the superconductive coils.

The coils perform very well as to resisting any movement of the turns of the coils. Any such movement can generate enough heat to cause loss of superconductivity. The coils produced by the method and apparatus of the present invention perform very well as to resistance to such loss of superconductivity.

Prior coils have sometimes been plagued by the effect known as training, in that prior coils have sometimes gone through repeated cycles, in which the coils have repeatedly lost superconductivity, and have had to be repeatedly recooled to restore superconductivity.

The coils made by the method and apparatus of the present invention perform very well as to minimizing the effect known as training.

Various modifications, alternatives and equivalents may be employed without departing from the true spirit and scope of the present invention, as defined in the following claims.

What is claimed is:

1. A method of making a curved generally pancake-shaped coil adapted to be mounted around a 180-degree segment of a cylindrical support, such method comprising the steps of providing a tubular mandrel having a tubular cylindrical substantially rigid mid-portion terminating at both ends in tapered tubular end portions formed with a multiplicity of longitudinal slots providing flexible fingers between said slots, providing an elongated oval shaped pole island in engagement with the outside of said cylindrical mid-portion and parallel with the axis thereof, winding an elongated electrical conductor around said pole island to form a multiplicity of generally oval shaped turns in engagement with a 180-degree segment of the outside of said mandrel, said turns having longitudinal portions with curved portions extending therebetween, the curved portions of at least some of said turns engaging said tapered end portions of said mandrel, providing tapered expansion members of circular cross section for expanding said tapered end portions, and inserting said expansion members into said tapered end portions of said mandrel and thereby displacing said flexible fingers outwardly into a generally cylindrical form so as to displace said curved portions of said turns into a shape conforming to said cylindrical form while also exerting increased tension upon the turns of the coil to minimize draping of the longitudinal portions of said turns and to enhance the mechanical integrity of said coil.

2. A method according to claim 1, including the provision of a clamping member in the form of a half cylinder, and clamping said coil with said clamping member while inserting said expansion members to assist in precisely shaping said coil to fit around said 180-degree segment.

3. A method according to claim 2, including the provision of an adhesive material for securing the turns of said coil together and maintaining the shape of said coil upon the removal of said coil from said mandrel, and causing said adhesive material to set after insertion of said expansion members into the end portions of said mandrel and after clamping said coil with said clamping member.

4. A method according to claim 3, in which said adhesive material is provided in the form of an epoxy material, the setting of said adhesive material being accomplished by causing said epoxy material to polymerize.

5. A method according to claim 1, comprising the provision of an adhesive material for securing the turns of said coil together and for maintaining the shape of said coil after removal of said coil from said mandrel, and causing said adhesive material to set after insertion of said expansion members into said end portions of said mandrel.

6. A method according to claim 5, in which said adhesive material is provided in the form of an epoxy material, the setting of said adhesive material being accomplished by causing said epoxy material to polymerize.

7. A method according to claim 1, in which said electrical conductor is provided in a form utilizing an electrically conductive material exhibiting the property of superconductivity when cooled below a predetermined temperature near absolute zero.

8. The method according to claim 1, additionally including the step of inserting a wedge-shaped strip of flexible material between selected successive turns of the electrical conductor.

9. The method according to claim 8, additionally include the step of forming the wedge-shaped strips from a resinous plastic material.

10. The method according to claim 1, additionally including the step of forming the electrical conductor so as to have a wedge-shaped cross-section.

11. Apparatus for use in winding a curved generally pancake-shaped coil configured to be mounted around a 180-degree segment of a cylindrical support, said apparatus comprising a tubular mandrel having a tubular cylindrical substantially rigid mid-portion terminating at both ends in tapered tubular end portions formed with a multiplicity of longitudinal slots providing flexible fingers between said slots, an elongated oval shaped pole island in engagement with the outside of said cylindrical mid-portion of said mandrel and parallel with the axis thereof, said mandrel and said pole island are configured to support a multiplicity of generally oval shaped turns of an elongated electrical conductor wound around said pole island and in engagement with a 180-degree segment of the outside of said mandrel with at least some of the curved portions of the turns engaging the tapered end portions of said mandrel, and tapered expansion members of circular cross-section for insertion into said tapered end portions of said mandrel to displace said flexible fingers outwardly into a generally cylindrical form so as to displace the curved portions of the turns into a shape conforming to said cylindrical form while also exerting increased tension upon the turns of the coil to minimize draping of longitudinal portions of the turns and to enhance the mechanical integrity of the coil.

12. Apparatus according to claim 11, in which said tapered expansion members are initially partially inserted into said tapered end portions of said mandrel, said tapered expansion members being movable into fully inserted positions within said tapered end portions upon completion of the winding of the coil.

13. Apparatus according to claim 11, including a clamping member in the form of a half cylinder, said clamping member being movable into clamping engagement with the completed coil to assist in shaping the coil to fit around a 180-degree segment of a cylindrical support.

* * * * *